US009603452B2

(12) United States Patent
Murphy et al.

(10) Patent No.: US 9,603,452 B2
(45) Date of Patent: Mar. 28, 2017

(54) GLIDING-RECLINING SEATING UNIT WITH POWER ACTUATORS

(71) Applicant: Ultra-Mek, Inc., Denton, NC (US)

(72) Inventors: Marcus L. Murphy, Lexington, NC (US); D. Stephen Hoffman, High Point, NC (US)

(73) Assignee: Ultra-Mek, Inc., Denton, NC (US)

( * ) Notice: Subject to any disclaimer, the term of this patent is extended or adjusted under 35 U.S.C. 154(b) by 91 days.

(21) Appl. No.: 14/513,619

(22) Filed: Oct. 14, 2014

(65) Prior Publication Data

US 2016/0100687 A1 Apr. 14, 2016

(51) Int. Cl.

| | |
|---|---|
| ***A47C 1/032*** | (2006.01) |
| ***A47C 1/034*** | (2006.01) |
| ***A47C 7/50*** | (2006.01) |

(52) U.S. Cl.

CPC ..... *A47C 1/03294* (2013.01); *A47C 1/0347* (2013.01); *A47C 7/503* (2013.01)

(58) Field of Classification Search

CPC .... A47C 1/03294; A47C 1/0347; A47C 7/503
USPC ..... 297/271.3, 271.4
See application file for complete search history.

(56) References Cited

U.S. PATENT DOCUMENTS

| | | | | |
|---|---|---|---|---|
| 4,536,029 | A | 8/1985 | Rogers, Jr. | |
| 4,544,201 | A | 10/1985 | Rogers, Jr. | |
| 4,915,444 | A | 4/1990 | Rogers, Jr. | |
| 6,120,095 | A * | 9/2000 | Rogers | A47C 1/0352 248/370 |
| 6,540,291 | B2 | 4/2003 | Hoffman et al. | |
| 7,445,278 | B2 * | 11/2008 | Wiecek | A47C 1/0355 297/326 |
| 7,673,933 | B2 * | 3/2010 | Lawson | A47C 1/0345 297/69 |
| 7,731,276 | B2 | 6/2010 | Hoffman et al. | |
| 8,297,693 | B2 | 10/2012 | Hoffman et al. | |
| 8,517,463 | B2 * | 8/2013 | Murphy | A47C 1/0355 297/270.1 |
| 8,714,638 | B2 * | 5/2014 | Hoffman | A47C 1/0342 297/83 |
| 2011/0304193 | A1 * | 12/2011 | Murphy | A47C 1/034 297/85 M |

(Continued)

*Primary Examiner* — Timothy J Brindley
(74) *Attorney, Agent, or Firm* — Myers Bigel, P.A.

(57) ABSTRACT

A reclining seating unit includes: a base; a seat having a seat frame; a gliding unit configured to allow the seat to reciprocate relative to the base; a backrest mounted and pivotally interconnected to the seat frame; a footrest unit; a reclining mechanism attached to the seat and the backrest, the reclining mechanism configured to control relative movement of the seat and backrest between upright and reclined positions; a footrest mechanism attached to the seat and the footrest unit, the footrest mechanism configured to control relative movement of the footrest unit and the seat between retracted and extended positions, the footrest mechanism being decoupled from the reclining mechanism; a first linear actuator attached to the reclining mechanism and to the seat configured to move the seat and backrest between the upright and reclined positions; and a second linear actuator attached to the footrest mechanism and to the seat frame configured to move the footrest unit between the retracted and extended positions.

7 Claims, 4 Drawing Sheets

(56) References Cited

U.S. PATENT DOCUMENTS

| | | | | |
|---|---|---|---|---|
| 2012/0112518 | A1* | 5/2012 | Murphy | A47C 1/0355<br>297/85 L |
| 2012/0119547 | A1* | 5/2012 | Hoffman | A47C 3/0255<br>297/84 |
| 2013/0062914 | A1* | 3/2013 | Marshall | A47C 7/506<br>297/69 |

* cited by examiner

GLIDING-RECLINING SEATING UNIT WITH POWER ACTUATORS

FIELD OF THE INVENTION

This invention relates generally to seating units, and relates more particularly to reclining seating units.

BACKGROUND OF THE INVENTION

Recliner chairs and other reclining seating units have proven to be popular with consumers. These seating units typically move from an upright position, in which the backrest is generally upright, to one or more reclined positions, in which the backrest pivots to be less upright. The movement of the seating unit between the upright and reclined positions is typically controlled by a pair of matching reclining mechanisms that are attached to the seat, backrest and base of the chair.

One particularly popular recliner is the "three-way" recliner, which has two reclined positions: a "TV position", in which the footrest or ottoman of the chair is projected forwardly from the chair while the backrest remains substantially upright; and a "fully reclined position", in which the backrest is less upright (i.e., it has been reclined to a shallower angle relative to the floor). In a "three-way" recliner, the backrest pivots relative to the seat as the chair takes its fully reclined position; this differs from a "two-way" recliner, in which the backrest and seat are rigidly fixed and do not pivot relative to one another as the chair moves to the fully reclined position. Many three-way recliners are constructed such that the backrest and footrest are coupled to one another, such that reclining of the backrest cannot occur unless the footrest is already extended (i.e., the chair is in the TV position). See, e.g., U.S. Pat. No. 4,915,444 to Rogers, Jr. and U.S. Pat. No. 6,540,291 to Hoffman, which illustrate chairs of rather contemporary style with three-way reclining capability. Other reclining chairs may have decoupled reclining and footrest-extending mechanisms. See, e.g., U.S. Pat. No. 7,731,276 to Hoffman et al.

In recent years, furniture designers have looked for alternatives to rocking chairs that can provide a similarly relaxing repetitive motion. One alternative has been the gliding chair, or "glider", which includes structure that enables the seat portion of the chair to "glide" forwardly and rearwardly relative to its base to mimic generally the rocking motion of a rocking chair. Often the gliding structure comprises a set of swing links (usually two at the front of the chair, and two at the rear) that are pivotally attached at their upper ends to the base and extend downwardly therefrom to attach to a structure, such as a mounting bracket, that is attached to the seat. In this configuration, the seat is suspended from the base and is free to swing forwardly and rearwardly in a double pendulum-type motion in response to a forwardly or rearwardly-directed force applied by a seated occupant. The gliding path of the chair is controlled by the configuration and mounting of the swing links. These chairs can be constructed to resemble traditional rocking chairs and thus are quite popular.

Reclining capability has been combined with gliding capability in a single unit to provide a chair that both reclines and glides. This chair includes a reclining mechanism that enables it to move between upright and one or more reclined positions, and further includes the aforementioned swing links attached between the base and the seat, armrests, or mechanism itself to enable the chair to glide. Examples of such chairs are illustrated and described in U.S. Pat. Nos. 4,536,029 and 4,544,201, both to Rogers, Jr., the disclosures of which are hereby incorporated herein by reference in their entireties.

Some reclining units have employed power actuators to recline the backrest and extend the footrest. See, e.g., U.S. Pat. No. 8,297,693 to Hoffman et al. It may be desirable to provide additional reclining units with power actuation, particularly in a glider-recliner.

SUMMARY OF THE INVENTION

As a first aspect, embodiments of the invention are directed to a reclining seating unit, comprising: a base; a seat having a seat frame; a gliding unit configured to allow the seat to reciprocate relative to the base; a backrest mounted and pivotally interconnected to the seat frame; a footrest unit; a reclining mechanism attached to the seat and the backrest, the reclining mechanism configured to control relative movement of the seat and backrest between upright and reclined positions; a footrest mechanism attached to the seat and the footrest unit, the footrest mechanism configured to control relative movement of the footrest unit and the seat between retracted and extended positions, the footrest mechanism being decoupled from the reclining mechanism; a first linear actuator attached to the reclining mechanism and to the seat configured to move the seat and backrest between the upright and reclined positions; and a second linear actuator attached to the footrest mechanism and to the seat frame configured to move the footrest unit between the retracted and extended positions.

DETAILED DESCRIPTION OF EMBODIMENTS OF THE INVENTION

Figure 1:
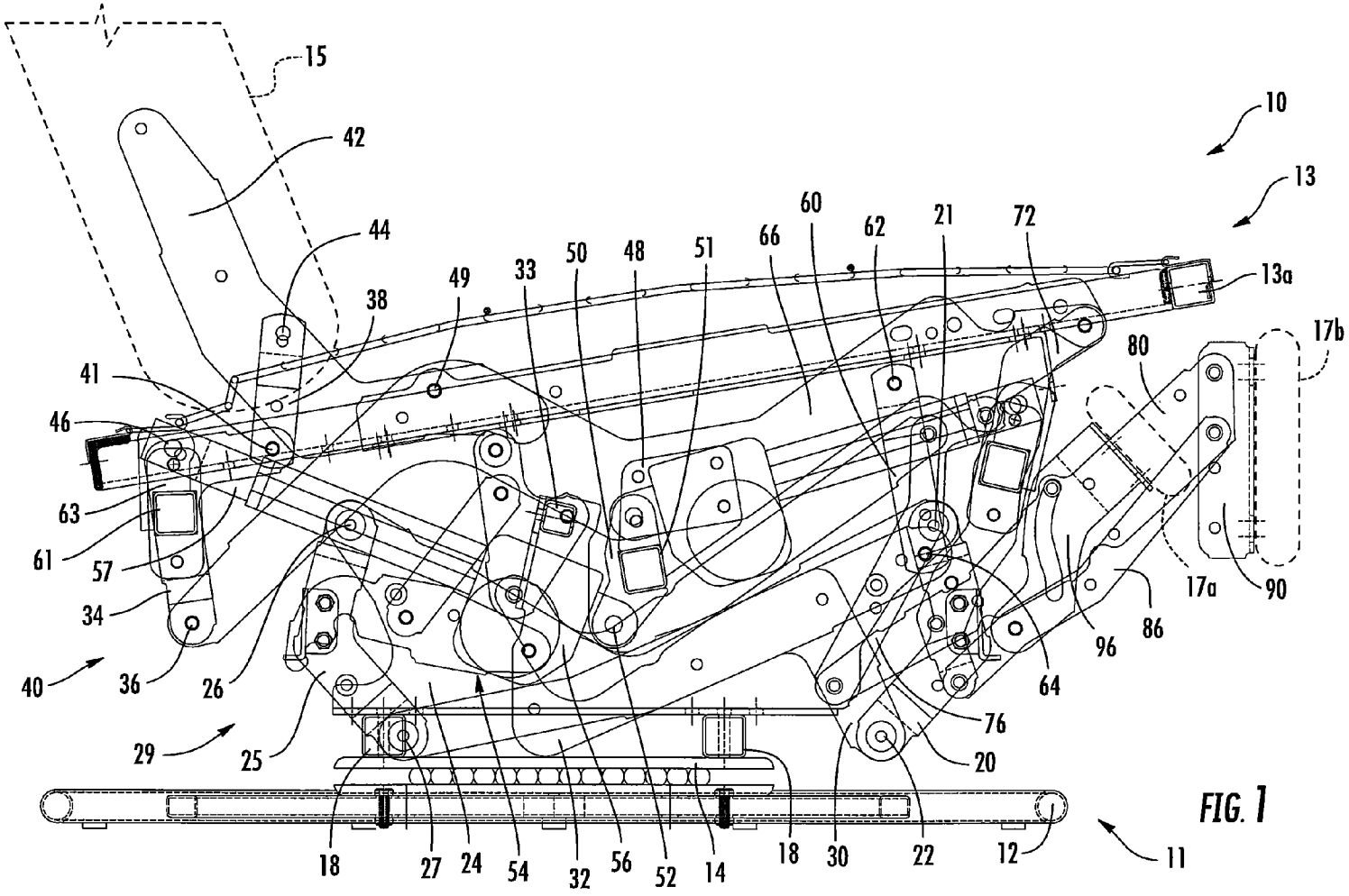
FIG. 1 is a side view of a gliding-reclining seating unit according to embodiments of the invention, with the backrest shown in an upright position and the footrests shown in a retracted position.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

The seating units illustrated and described herein comprise a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul, *Kinematics and Dynamics of Planar Machinery* 4-21 (1979).

Referring now to FIGS. 1-4, another embodiment of a glider-recliner, designated broadly at 10, is illustrated therein. The chair 10 includes a base unit 11, a seat 13 that is generally horizontally disposed above the base unit 11 and includes an underlying open seat frame 13*a*, a backrest 15 that is generally vertically and disposed substantially above a rear portion of the seat 13, an arm frame (not shown), and two footrests 17*a*, 17*b*, which, in the upright position of FIG. 1, are generally vertically disposed below a front portion of the seat 13. Arms (not shown) are positioned on either side of the seat 13 and move in concert with the seat 13.

The base unit 11 includes a circular lower base 12. A swivel unit 14 is mounted onto the top of the lower base 12. Cross-members 18 are mounted atop the swivel unit 14. Those skilled in this art will recognize that the base unit 11 may take other forms that provide mounting locations for the remaining components of the chair 10; for example, the swivel unit 14 may be omitted.

Glide foundation plates 24 are mounted to the top surfaces of the cross-members 18. A front glide link 20 is attached at a pivot 21 to the front end of the glide foundation plate 24, and a rear glide link 25 is attached at a pivot 26 to the rear end of the glide foundation plate 24. The front and rear glide links 20, 25 are suspended from the glide foundation plate 24 and together form a gliding mechanism 29 that provides a gliding motion to the seat, arm frame and backrest of the chair 10 when it is in its upright position (FIG. 1). The lower ends of the front and rear glide links 20, 25 are attached to a mounting bracket 30 at pivots 22, 27. The mounting bracket 30 is fixed to a second mounting bracket 32. The arm brackets 32 are spanned by a cross-member 33. Those skilled in this art will appreciate that the gliding mechanism may take other forms; it may include glide links of different shapes, or it may include a "track"-based gliding mechanism.

A seat adapter 66 is mounted to the seat frame 13*a*. A swing link 60 is mounted to the front portion of the seat adapter 66 at a pivot 62 and to a front portion of the mounting bracket 32 at a pivot 64. Also, a V-shaped swing link 134 is attached at the upper end of its rearward leg to the seat adapter at a pivot 135.

The chair 10 includes a reclining mechanism 40 that reclines the backrest 15 relative to the seat 13. The reclining mechanism 40 includes an L-shaped drive link 34 that is attached to the rear end of the seat adapter 66 at a pivot 36. At its opposite end, the drive link 34 is attached to the lower end of a control link 38 at a pivot 41. A backpost 42 is fixed to the backrest 15. The front end of the backpost 42 is attached to the seat adapter 66 at a pivot 49. The upper end of the control link 38 is attached to the backpost 42 at a pivot 44.

A linear actuator 54 controls the movement of the reclining mechanism 40. The linear actuator 54 includes a motor 56 and a retractable rod 57. The rod 57 is attached in alignment with the vertex of the drive link 34 at a pivot 46 via a cross-member 61 and a bracket 63. At the opposite end of the linear actuator 54, the motor 56 is mounted to the seat adapter 66 via a mounting plate 48 fixed to the seat adapter 66, a cross-member 51 that spans the mounting plates 48 on either side of the chair 10, and a dual tab 50 fixed to the cross-member 51; the motor 56 is mounted to the lower end of the dual tab 50 at a pivot 52.

Figure 2:
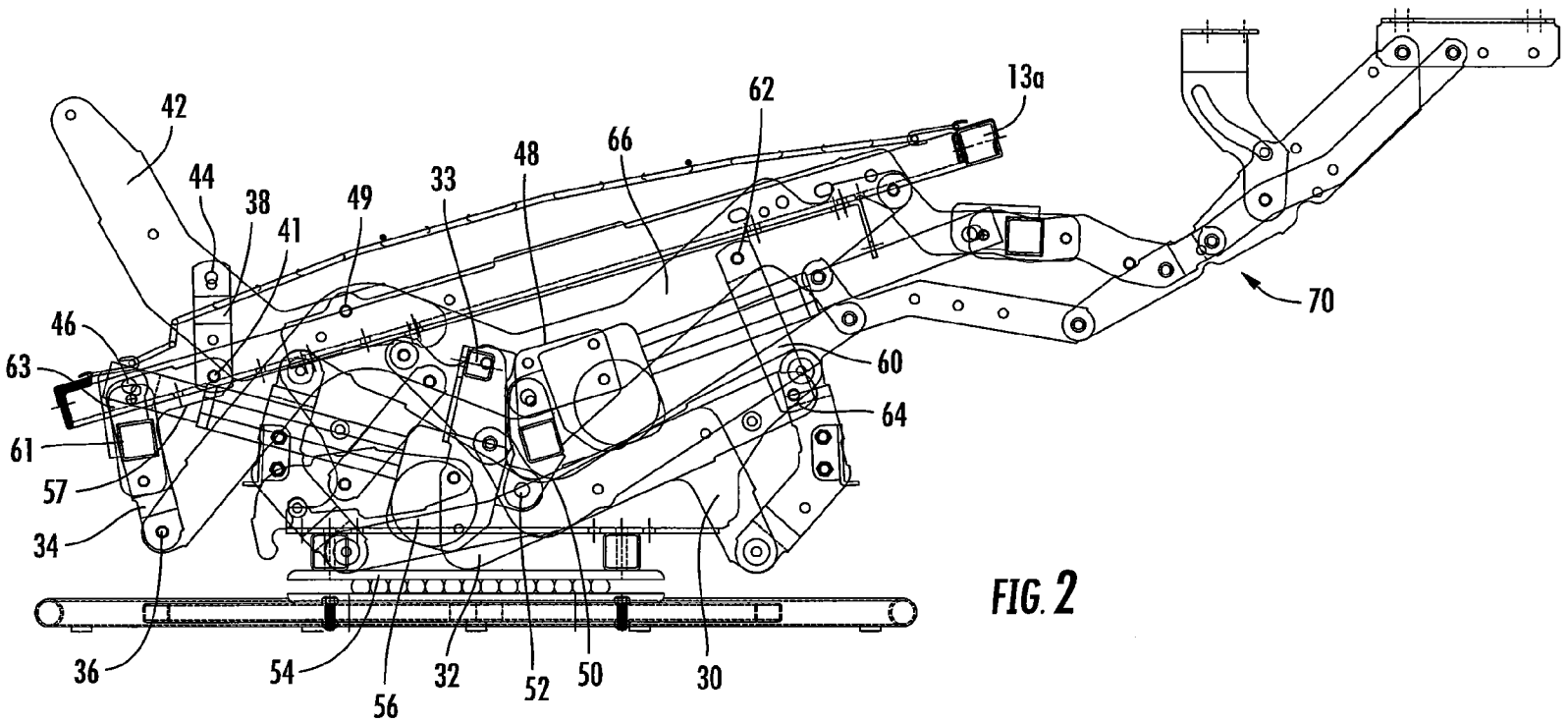
FIG. 2 is a side view of the seating unit of FIG. 1, with the backrest shown in an upright position and the footrests shown in an extended position.

The backrest 15 is shown in FIGS. 1 and 2 in its upright position. To move the backrest 15 to its reclined position, an occupant of the chair 10 actuates the motor 56 of the linear actuator 54, which causes the rod 57 to retract. Retraction of the rod 57 rotates the drive link 34 clockwise about the pivot 36, which forces the control link 38 forwardly and downwardly and causes it to rotate counterclockwise about the pivot 44. Movement of the control link 38 draws the backpost 42 (and in turn the backrest 15) counterclockwise about the pivot 49 with the seat adapter 66. Thus, the backrest 15 reclines relative to the seat 13.

Figure 3:
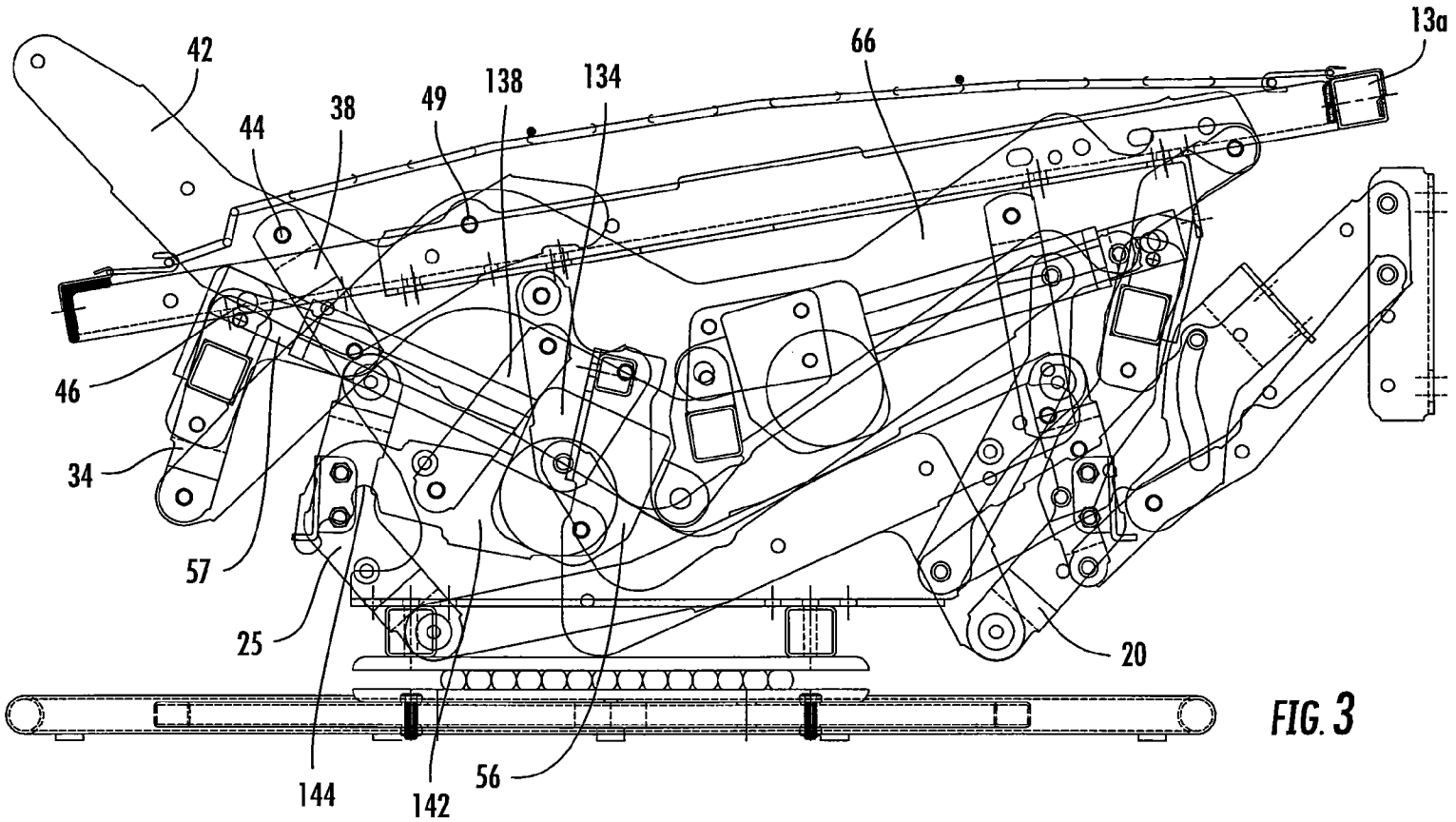
FIG. 3 is a side view of the seating unit of FIG. 1, with the backrest shown in a reclined position and the footrests shown in a retracted position.
Figure 4:
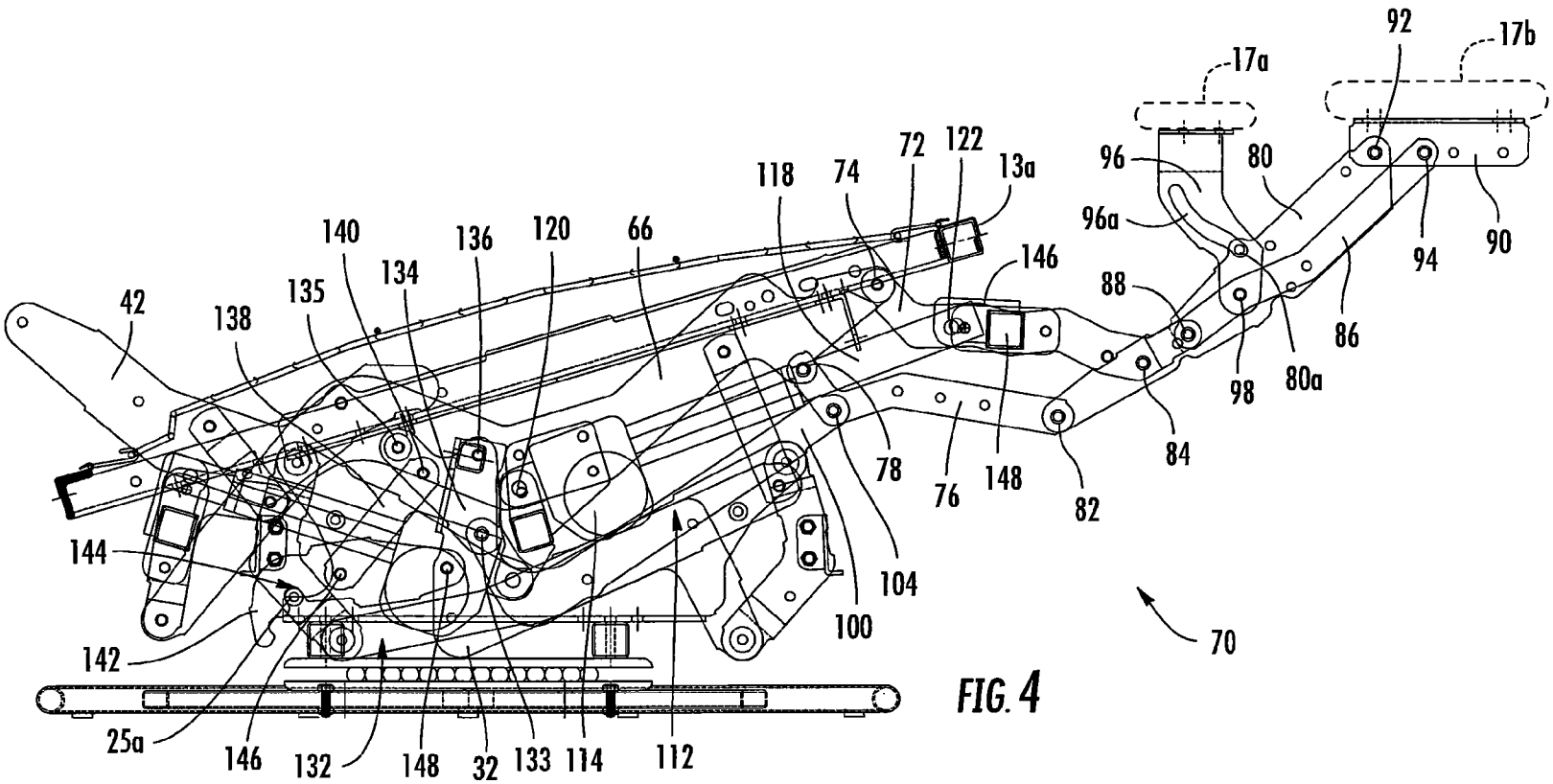
FIG. 4 is a side view of the seating unit of FIG. 1, with the backrest shown in a reclined position and the footrests shown in an extended position.

It will be understood that the backrest 15 can recline relative to the seat 13 whether the footrests 17*a*, 17*b* are retracted as in FIGS. 1 and 3 or extended as in FIGS. 2 and 4. Also, the seat 13 and backrest 15 are free to glide relative to the base 11 in either the upright position or the reclined position as long as the footrests 17*a*, 17*b* are retracted as shown in FIGS. 1 and 3.

Referring now to FIG. 4, the footrest mechanisms 70 interconnect the footrests 17*a*, 17*b* with the seat frame 13*a* (FIG. 4 shows the footrests 17*a*, 17*b* in their extended position for clarity of description). An upper ottoman swing link 72 is attached to a front region of the seat adapter 66 at a pivot 74 and extends downwardly and forwardly therefrom. A tripartite lower ottoman swing link 76 is attached to a pivot 78 that is located rearwardly and downwardly from the pivot 74; the lower ottoman swing link 76 extends generally forwardly from the pivot 78. An upper ottoman extension link 80 is attached to the forward end of the lower ottoman swing link 76 at a pivot 82 and extends forwardly and upwardly therefrom. Also the upper ottoman extension link 80 is attached to the upper ottoman swing link at a pivot 84. A lower ottoman extension link 86 is attached to the forward end of the upper ottoman swing link at a pivot 88 that is positioned above and forward of the pivot 84 and extends upwardly and forwardly therefrom generally parallel with the upper ottoman extension link. An outer ottoman bracket 90 is generally horizontally disposed and is attached to the upper and lower ottoman extension links 80, 86 at pivots 92, 94 respectively. The ottoman 17*b* is mounted on the outer ottoman bracket 90.

A bi-angled inner ottoman bracket 96 is attached at its lower, forward end to the lower ottoman extension link 86 at a pivot 98. At its opposite end, the inner ottoman bracket 96 supports the ottoman 17*a*. The inner ottoman bracket 96 also includes a slot 96*a* that receives a pin 80*a* located on the upper ottoman extension link 80.

Referring still to FIG. 4, the chair 10 includes a linear actuator 112 that drives the footrests 17*a*, 17*b* between their retracted and extended positions. The actuator 112 includes a motor 114 and a retractable rod 118. The motor 114 is attached to the upper end of the dual tab 50 at a pivot 120. The rod 118 of the actuator 112 is attached at a pivot 122 to a projecting bracket 146 that extends from a cross-member 148 between the upper ottoman swing links 72.

An angled connecting link 100 is attached at a pivot 104 with the lower ottoman swing link 76 and extends rearwardly and slightly downwardly therefrom. The connecting link 100 is pivotally connected to a locking mechanism 132 that can prevent the seat 13 and backrest 15 from gliding relative to the base 11 when the footrests 17*a*, 17*b* are extended. The locking mechanism 132 includes the V-shaped swing link 134, which is attached at its vertex to the rear end of the connecting link 100 at a pivot 133. At the end of its forward leg, the link 134 is attached to the bracket 32 at a pivot 136. A drive link 138 is attached at a pivot 140 to the link 134 just below the pivot 135. A locking link 142 with a pocket 144 is attached to the drive link 138 at a pivot 146, and is also mounted at its front end to the bracket 32 at a pivot 148. The pocket 144 is sized to receive a pin 25*a* fixed to the rear glide link 25.

As can be seen in FIG. 1, in the retracted position, the rod 118 of the actuator 112 is retracted. Because the rod 118 is in its retracted position, a pantographic linkage formed by the upper and lower ottoman swing links 72, 76 and the upper and lower ottoman extension links 80, 86 is folded under the seat frame 13*a*, which positions the footrest 17*a* underneath a forward portion of the seat frame 13*a* and the footrest 17*b* just forward of and below the seat frame 13*a* in a vertical orientation. Also, the locking link 142 is rotated about the pivot 148 to a position in which the pocket 144 is above the pin 25*a* on the rear glide link 25. As such, the seat 13 and backrest 15 are free to glide longitudinally relative to the base 11.

To move the footrests 17*a*, 17*b* from their retracted positions in FIG. 1 to their extended positions of FIGS. 2 and 4, an occupant of the chair 10 actuates the actuator 112, which causes the rod 118 to begin to extend away from the motor unit 114, thereby driving the lower ottoman swing link 76 counterclockwise about the pivot 78. Rotation of the lower ottoman swing link 76 forces the upper ottoman extension link 80 forward, which in turn draws the upper ottoman swing link 72 counterclockwise around the pivot 74. Also, the lower ottoman extension link 86 moves forwardly more than the upper ottoman extension link 80, such that the outer ottoman bracket 90 and the inner ottoman bracket 96 rotate counterclockwise (rotation of the inner ottoman bracket 96 causes the pin 80*a* to move in the slot 96*a* toward the pivot 98). The rotation of the outer and inner ottoman brackets 90, 96 induces the footrests 17*a*, 17*b* to rotate from a vertical orientation to a horizontal orientation.

In addition, the rotation of the lower ottoman swing link 76 draws the connecting link 100 forward. Movement of the connecting link 100 rotates the swing link 134 counterclockwise about the pivot 136, which draws the seat adapter 66 (and in turn the seat 13) slightly downwardly to increase the pitch angle of the seat 13. The front of the seat 13 is supported by the swing link 60, which pivots slightly counterclockwise about the pivot 64.

Rotation of the swing link 134 also drives the drive link 138 downwardly. The downward movement of the drive link 138 rotates the locking link 142 counterclockwise about the pivot 148, with the result that the pocket 144 descends onto and captures the pin 25*a* of the rear glide link 25. This, the locking mechanism 132 prevents relative movement between the front and rear glide links 20, 25 and the seat 13, thereby preventing the seat 13 from gliding relative to the base unit 11.

One potential advantage to embodiments of the invention assists in manufacturing of the chair. During manufacture, the reclining mechanisms, footrest mechanisms, the linear actuators, the gliding mechanism and the base can be formed as a single assembly. Once constructed, they can be dropped into an inverted chair frame as a single unit and quickly and easily mounted to the backrest and seat and arm frames with a few screws and/or bolts. As such, construction of the seating unit is simplified markedly over typical recliners.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention.

That which is claimed is:

1. A reclining seating unit, comprising:

a base;

a seat having a rigid seat frame assembly including a seat adapter;

a gliding unit configured to allow the seat to reciprocate relative to the base;

a backrest mounted and pivotally interconnected to the seat frame;

a footrest unit;

a reclining mechanism attached to the seat and the backrest, the reclining mechanism configured to control relative movement of the seat and backrest between upright and reclined positions;

a footrest mechanism attached to the seat and the footrest unit, the footrest mechanism configured to control relative movement of the footrest unit and the seat between retracted and extended positions, the footrest mechanism being decoupled from the reclining mechanism;

a first power linear actuator attached to the reclining mechanism and to the seat frame assembly configured to move the seat and backrest between the upright and reclined positions; and a second power linear actuator attached to the footrest mechanism and to the seat frame assembly configured to move the footrest unit between the retracted and extended positions;

wherein the first linear actuator and the second linear actuator are pivotally mounted to a common link; and wherein the common link moves rearwardly relative to the base as the footrest unit moves to the extended position.

2. The seating unit defined in claim 1, wherein the second linear actuator extends to move the footrest unit to the extended position, and the first linear actuator retracts to move the backrest to the reclined position.

3. The seating unit defined in claim 1, wherein each of the first and second linear actuators includes a motor, and wherein each of the motors is mounted beneath the seat.

4. The seating unit defined in claim 1, farther comprising a locking mechanism coupled to the footrest mechanism, the locking mechanism configured to prevent gliding of the seat relative to the base when the footrest unit is in the extended position.

5. The seating unit defined in claim 4, wherein the reclining mechanism includes front and rear swing links pivotally attached to the seat and the gliding unit, and wherein the locking mechanism comprises the rear swing link.

6. A reclining seating unit, comprising:

a base;

a seat having a rigid seat frame assembly including a seat adapter;

a gliding unit configured to allow the seat to reciprocate relative to the base;

a backrest mounted and pivotally interconnected to the seat frame;

a footrest unit;

a reclining mechanism attached to the seat and the backrest, the reclining mechanism configured to control relative movement of the seat and backrest between upright and reclined positions;

a footrest mechanism attached to the seat and the footrest unit, the footrest mechanism configured to control relative movement of the footrest unit and the seat between retracted and extended positions, the footrest mechanism being decoupled from the reclining mechanism;

a first power linear actuator attached to the reclining mechanism and to the seat frame assembly configured to move the seat and backrest between the upright and reclined positions; and a second power linear actuator attached to the footrest mechanism and to the seat frame assembly configured to move the footrest unit between the retracted and extended positions;

wherein the first linear actuator and the second linear actuator are pivotally mounted to a common link;

wherein the common link moves rearwardly relative to the base as the footrest unit moves to the extended position; and wherein the second linear actuator extends to move the footrest unit to the extended position.

7. A reclining seating unit, comprising:

a base;

a seat having a rigid seat frame assembly including a seat adapter;

a gliding unit configured to allow the seat to reciprocate relative to the base;

a backrest mounted and pivotally interconnected to the seat frame;

a footrest unit;

a reclining mechanism attached to the seat and the backrest, the reclining mechanism configured to control relative movement of the seat and backrest between upright and reclined positions;

a footrest mechanism attached to the seat and the footrest unit, the footrest mechanism configured to control relative movement of the footrest unit and the seat between retracted and extended positions, the footrest mechanism being decoupled from the reclining mechanism;

a first power linear actuator attached to the reclining mechanism and to the seat frame assembly configured to move the seat and backrest between the upright and reclined positions; and a second power linear actuator attached to the footrest mechanism and to the seat frame assembly configured to move the footrest unit between the retracted and extended positions;

wherein the first linear actuator and the second linear actuator are pivotally mounted to a common link;

wherein the common link moves rearwardly relative to the base as the footrest unit moves to the extended position; and wherein the first linear actuator retracts to move the backrest to the reclined position.

* * * * *